US009499381B2

(12) United States Patent
Holthaus

(10) Patent No.: US 9,499,381 B2
(45) Date of Patent: Nov. 22, 2016

(54) BUNG PLUG EXTRACTOR AND METHODS FOR TRANSFERRING FLUID WITH A PRESSURIZED TANK

(71) Applicant: The Boeing Company, Seal Beach, CA (US)

(72) Inventor: Mark J. Holthaus, Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 346 days.

(21) Appl. No.: 14/193,064

(22) Filed: Feb. 28, 2014

(65) Prior Publication Data

US 2015/0246803 A1 Sep. 3, 2015

(51) Int. Cl.
*B67B 7/42* (2006.01)
*B67D 7/02* (2010.01)
(Continued)

(52) U.S. Cl.
CPC ..... *B67B 7/42* (2013.01); *B67D 7/0288* (2013.01); *B25B 27/0042* (2013.01);
(Continued)

(58) Field of Classification Search
CPC ..... B67B 7/42; Y10T 137/6133; Y10T 137/048
(Continued)

(56) References Cited

U.S. PATENT DOCUMENTS 1,483,964 A * 2/1924 Abramovitz ..... F16K 43/001 137/319
2,084,200 A * 6/1937 Karlson ..... B67D 1/0835 137/319
(Continued)

FOREIGN PATENT DOCUMENTS

EP 0685398 A1 12/1995
EP 2685147 A1 1/2014
(Continued)

OTHER PUBLICATIONS

An International Search Report and Written Opinion, dated Apr. 30, 2015, from the International Searching Authority, for co-pending International application No. PCT/US2014/066548 (11 pgs.).
(Continued)

*Primary Examiner* — Mark A Laurenzi
*Assistant Examiner* — Timothy P Kelly
(74) *Attorney, Agent, or Firm* — Armstrong Teasdale LLP

(57) ABSTRACT

An apparatus for exchanging fluid with a tank through a tank port includes a bung extractor casing that has a first end configured to removably couple to a tank port. The tank port is configured to be sealingly coupled to a bung plug. The bung extractor casing also includes a second end opposite the first end, a hose connector configured to removably couple to a hose, and a channel defined between the first end and the hose connector. The apparatus also includes a bung extractor coupled to the extractor casing second end. The bung extractor includes a tip portion configured to releasably engage the bung plug. The bung extractor is operable to
(Continued)

selectively uncouple the bung plug from the tank port such that a sealed flow path is formed through the tank port and the channel.

17 Claims, 10 Drawing Sheets

(51) Int. Cl.
*B25B 27/00* (2006.01)
*B67D 7/04* (2010.01)

(52) U.S. Cl.
CPC .. *B67D 2007/0405* (2013.01); *Y10T 137/0402* (2015.04); *Y10T 137/6126* (2015.04)

(58) Field of Classification Search
USPC ..... 137/319–321, 15.16, 15.17
See application file for complete search history.

(56) References Cited

U.S. PATENT DOCUMENTS 4,420,012 A * 12/1983 Astrom ..... B67B 7/42 137/319
4,714,138 A 12/1987 Zaccone
4,899,780 A * 2/1990 Astrom ..... B67B 7/42 137/319
5,479,955 A * 1/1996 Roodvoets ..... B65B 55/022 137/15.16
5,582,366 A 12/1996 Hamant et al.
8,448,904 B2 5/2013 Gryniewski et al.
2005/0199313 A1 * 9/2005 Edwards ..... B65B 3/045 141/114

FOREIGN PATENT DOCUMENTS

WO 8001796 A1 9/1980
WO 8900973 A1 2/1989
WO 9216449 A1 10/1992

OTHER PUBLICATIONS

Product information for High Pressure Gas Fill & Drain Valves by Vacco Industries, retrieved from website http://www.vacco.com/images/uploads/pdfs/fd_high_pressure.pdf (8 pgs).

* cited by examiner

BUNG PLUG EXTRACTOR AND METHODS FOR TRANSFERRING FLUID WITH A PRESSURIZED TANK

BACKGROUND

The field of the disclosure relates generally to filling, draining, and venting tanks, and, more particularly, to a bung plug and extractor system for use in exchanging fluid with pressurized tanks.

At least some known tanks, such as known propellant and pressurant tanks used within liquid rockets, for example, include one or more tank ports that enable exchanges of fluid with the tank, such as occurs when filling, draining, or venting the tank. The fluid may be a gas and/or a liquid. Such fluid exchange operations must be enabled while the tank contents are under pressure, but without spillage or leakage of the fluid. Fluid transfer may be further complicated if the fluid is toxic, highly volatile (flammable or explosive), and/or in a cryogenic state. To enable fluid transfer, at least some known tanks include a fill/drain port and a vent port, with dedicated high-pressure fill/drain valves and vent valves internal or external to the tank and between the tank and the respective ports, such that only a simple hose connection to each tank port is needed. However, at least some known fill/drain valves and vent valves add considerable weight, cost, and component volume to the pressurized tank. Moreover, the reliability of such valves may be limited.

BRIEF DESCRIPTION

In one aspect, an apparatus for exchanging fluid with a tank through a tank port is provided. The apparatus includes a bung extractor casing that has a first end configured to removably couple to a tank port. The tank port is configured to be sealingly coupled to a bung plug. The bung extractor casing also includes a second end opposite the first end, a hose connector configured to removably couple to a hose, and a channel defined between the first end and the hose connector. The apparatus also includes a bung extractor coupled to the extractor casing second end. The bung extractor includes a tip portion configured to releasably engage the bung plug. The bung extractor is operable to selectively uncouple the bung plug from the tank port such that a sealed flow path is formed through the tank port and the channel.

In another aspect, a bung plug extractor system is provided. The bung plug extractor system includes a bung plug configured to sealingly couple to a tank port and a bung extractor casing. The bung extractor casing includes a first end configured to removably couple to the tank port, a second end opposite the first end, a hose connector configured to removably couple to a hose, and a channel defined between the first end and the hose connector. The bung plug extractor system also includes a bung extractor coupled to the extractor casing second end. The bung extractor includes a tip portion configured to releasably engage the bung plug. The bung extractor is operable to selectively uncouple the bung plug from the tank port such that a sealed flow path is formed through the tank port and the channel.

In yet another aspect, a method of exchanging fluid with a tank is provided. The method includes coupling a first end of a bung extractor casing to a tank port. A bung plug remains sealingly coupled to the tank port as the first end is coupled thereto. The extractor casing includes a second end opposite the first end, a hose connector, and a channel defined between the first end and the hose connector. The method also includes extending a bung extractor through the channel and through the extractor casing first end. The bung extractor is extendably coupled to the extractor casing second end. The method further includes releasably engaging the bung plug with a tip portion of the bung extractor, uncoupling the bung plug from the tank port using the bung extractor such that a sealed flow path is formed through the tank port and the channel, and exchanging fluid with the tank through the sealed flow path.

DETAILED DESCRIPTION

The apparatus and methods described herein enable fluid exchange with a tank, such as filling, draining, and venting of a gas and/or liquid from the tank, during ground operations while the tank contents are under pressure, and without spillage or leakage of the fluid. Moreover, the described apparatus and methods enable such operations to be performed without requiring dedicated valve hardware to be coupled to each tank port. Accordingly, the described systems and methods facilitate a reduction in weight, cost, and component volume for each tank.

Figure 1:
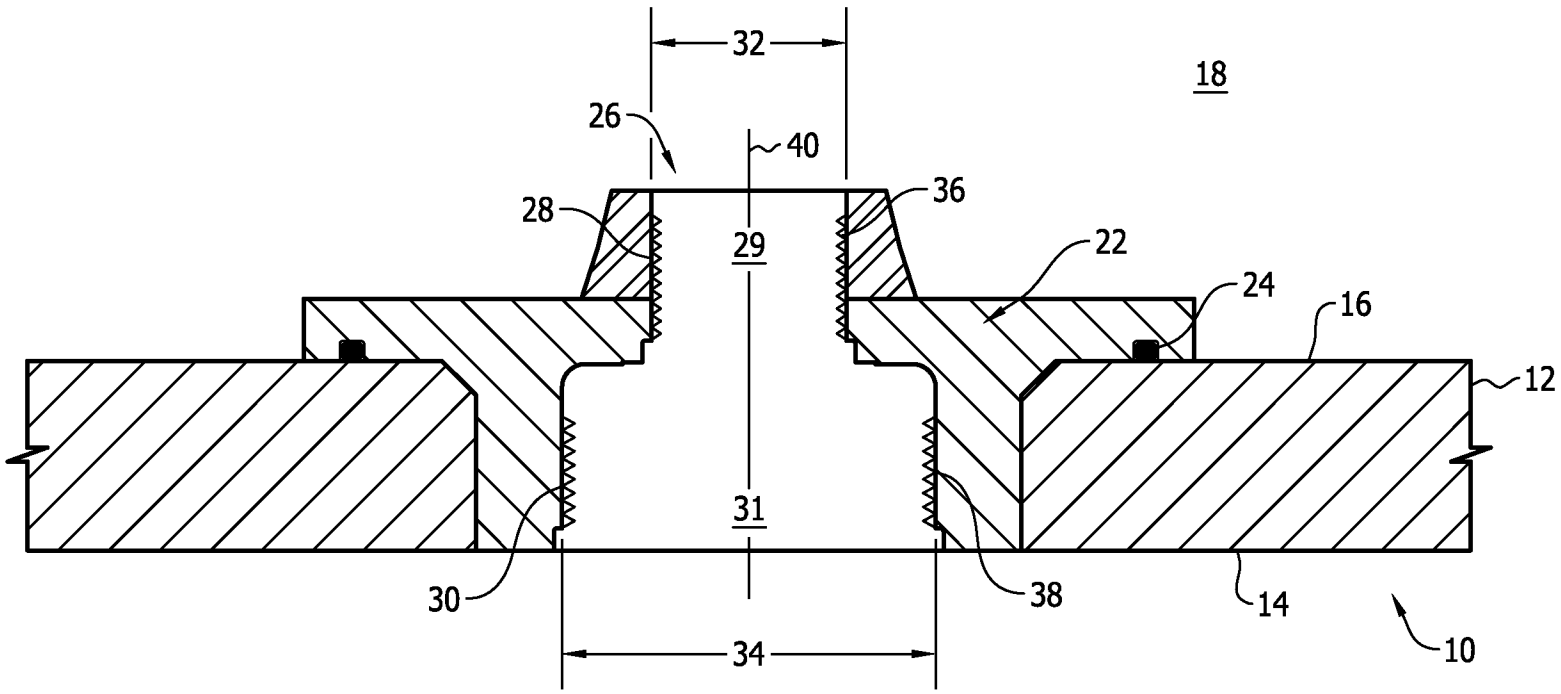
FIG. 1 is a schematic cross-sectional view of an exemplary tank wall and tank port.

Referring more particularly to the drawings, FIG. 1 is a schematic cross-sectional view of a tank wall 12 of an example tank 10. Tank 10 may be, for example, a propellant or pressurant tank used within a liquid rocket. Tank wall 12 has an outer surface 14 and an inner surface 16. A tank cavity 18 is defined by inner surface 16. Tank cavity 18 is configured to hold a fluid 20 (shown in FIG. 2). Fluid 20 may be a gas, liquid, or a combination of gas and liquid. In the example embodiment, tank wall 12 is configured to enable tank 10 to hold fluid 20 in a pressurized state. In some embodiments, tank cavity 18 also is configured to hold fluid 20 in a cryogenic state. In alternative embodiments, tank 10 may hold fluid 20 in a non-pressurized state.

An exemplary tank port 22 installed in, or integral with, tank wall 12 extends through outer surface 14 and inner surface 16. For example, tank port 22 may be a fill/drain port or a vent port. In alternative embodiments, tank 10 has a multiple-walled structure (not shown), such as double-walled, and tank port 22 extends through an inner and an outer surface of each wall 12. In the example embodiment, at least one seal 24, for example an O-ring, is provided between tank port 22 and tank wall 12 to inhibit leakage of fluid 20 from tank cavity 18 through tank wall 12. In alternative embodiments, tank port 22 is formed integrally with tank wall 12.

An opening 26 defined in tank port 22 extends through tank port 22 along an axis 40. In the example embodiment, a first portion 29 of opening 26 is at least partially defined by a first wall 28 that is substantially circular in cross-section, and a second portion 31 of opening 26 is at least partially defined by a second wall 30 that is substantially circular in cross-section. First portion 29 and second portion 31 are disposed substantially coaxially along axis 40. In alternative embodiments, first portion 29 and second portion 31 are disposed other than substantially coaxially along axis 40. In the example embodiment, first portion 29 has a first diameter 32, and second portion 31 has a second diameter 34 that is larger than first diameter 32, for reasons that will be described herein. In alternative embodiments, second diameter 34 is equal to or smaller than first diameter 32. In addition, in the example embodiment, at least a portion of first wall 28 includes a threaded surface 36, and at least a portion of second wall 30 includes a threaded surface 38.

Figure 2:
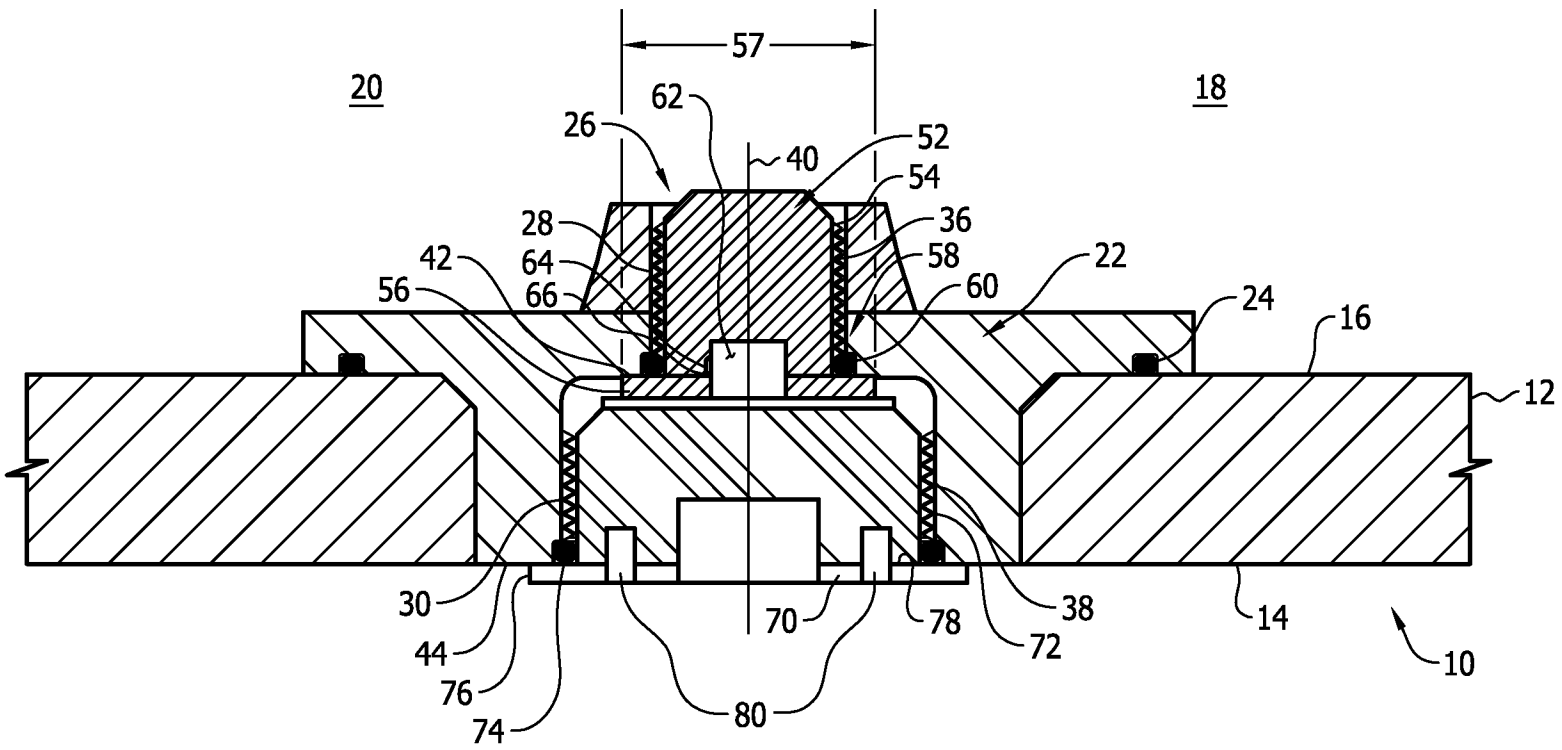
FIG. 2 is a schematic cross-sectional view of an exemplary bung plug and outer cap installed in the tank port shown in FIG. 1.

FIG. 2 is a schematic cross-sectional view of an example bung plug assembly 50 installed in opening 26 of tank port 22. Bung plug assembly 50 includes a bung plug 52 configured to be removably and sealingly coupled within first portion 29 of opening 26 adjacent to first wall 28. In the example embodiment, bung plug 52 includes a threaded surface 54 that cooperates with threaded surface 36 of first wall 28 to enable removable coupling of bung plug 52 within first portion 29 of opening 26. In alternative embodiments, at least one of first wall 28 and bung plug 52 contains additional or alternative structure to enable removable coupling of bung plug 52 within first portion 29.

Bung plug 52 also includes a rim 56 that has a diameter 57 larger than first portion diameter 32 (shown in FIG. 1), but less than second portion diameter 34 (shown in FIG. 1). Rim 56 is configured to facilitate seating bung plug 52 at a desired axial depth along first wall 28 of opening 26. More specifically, rim 56 abuts an intermediate seating surface 42 of tank port 22 when bung plug 52 is seated at the desired depth. In the example embodiment, rim 56 is disposed at a first end 58 of bung plug 52. In alternative embodiments, rim 56 is disposed at an intermediate axial location along bung plug 52. In the example embodiment, at least one seal 60, for example an O-ring, is provided between tank port 22 and bung plug 52 to inhibit leakage of fluid 20 from tank cavity 18 through tank port 22.

Bung plug 52 is configured to be releasably engaged by a tip portion 192 of a bung extractor 190 (shown in FIG. 4), as will be described herein. For example, in the embodiment illustrated in FIG. 3, bung plug 52 includes a gap 62 defined in first end 58. Gap 62 is at least partially defined by an outer surface 66 of bung plug 52. At least one notch 64 is defined in bung plug outer surface 66, and the at least one notch 64 is configured to engage a detent 194 (shown in FIG. 4) disposed on tip portion 192, thus enabling bung plug 52 to be releasably engaged by tip portion 192. In alternative embodiments, bung plug 52 includes additional or alternative structure to enable bung plug 52 to be releasably engaged by tip portion 192.

Bung plug assembly 50 also includes a cap 70 configured to be removably and sealingly coupled within second portion 31 of opening 26 adjacent to second wall 30. When cap 70 is coupled within second portion 31 of opening 26, cap 70 facilitates protecting rim 56, gap 62, outer surface 66, and notch 64 from dirt, debris, corrosion, or other environmental conditions. Cap 70 also provides a redundant seal for tank port 22. In the example embodiment, cap 70 includes a threaded surface 72 that cooperates with threaded surface 38 of second wall 30 to enable removable coupling of cap 70 within second portion 31 of opening 26. In alternative embodiments, at least one of second wall 30 and cap 70 includes additional or alternative structure to enable removable coupling of bung cap 70 within second portion 31.

Cap 70 also includes a rim 76 that has a diameter larger than second portion diameter 34 (shown in FIG. 1). Rim 76 is configured to facilitate seating cap 70 at a desired axial depth along second wall 30. More specifically, rim 76 abuts an outer surface 44 of tank port 22 when cap 70 is seated at the desired depth. In the example embodiment, rim 76 is disposed at a first end 78 of cap 70. In alternative embodiments, rim 76 is disposed at an intermediate axial location along cap 70. In the example embodiment, at least one seal 74, for example an O-ring, is provided between tank port 22 and cap 70 to inhibit leakage of fluid 20 from tank cavity 18 through tank port 22.

In the example embodiment, cap 70 further includes a pair of slots 80 defined in first end 78. Slots 80 are configured to cooperate with a cap wrench (not shown) to facilitate uncoupling cap 70 from second portion 31, for example by rotating cap 70 to disengage threaded surface 72 of cap 70 from threaded surface 38 of second wall 30. In alternative embodiments, cap 70 includes additional or alternative structures to facilitate uncoupling cap 70 from second wall 30. To selectively fill, drain, or vent tank 10 using tank port 22, cap 70 is uncoupled from within second portion 31, and a bung plug extractor system, such as an example bung plug extractor system 100 illustrated in FIGS. 3-6, is coupled to tank port 22.

Figure 3:
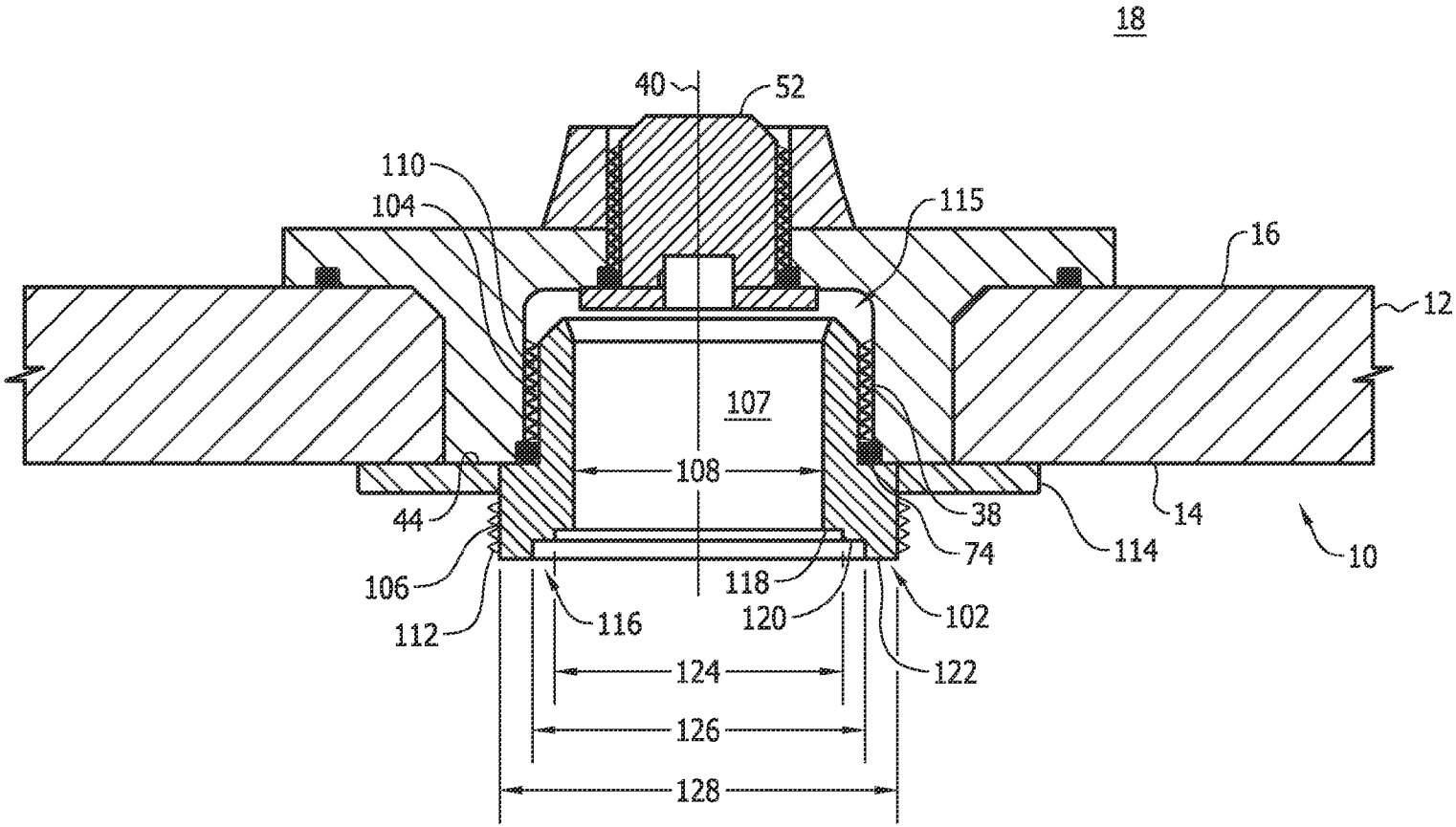
FIG. 3 is a schematic cross-sectional view of an exemplary bung extractor mount coupled within the tank port shown in FIGS. 1 and 2.

Example bung plug extractor system 100 includes a bung extractor mount, such as bung extractor mount 102, shown coupled within opening 26 of tank port 22 in a schematic cross-sectional view in FIG. 3. In the example embodiment, mount 102 includes a substantially annular first portion 104 and a substantially annular second portion 106 disposed substantially coaxially along axis 40. In alternative embodiments, first portion 104 and second portion 106 are disposed other than substantially coaxially along axis 40.

A channel 107 extends through mount 102 from a first end 115 to a second end 116. In the example embodiment, first end 115 and second end 116 are oppositely disposed along axis 40. In addition, channel 107 has a constant diameter 108 that is at least slightly larger than diameter 57 of bung plug rim 56. In alternative embodiments, first end 115 and second end 116 are other than oppositely disposed along axis 40, and/or diameter 108 varies along channel 107.

In addition, at least a portion of mount first portion 104 includes a threaded surface 110, and at least a portion of mount second portion 106 includes a threaded surface 112. Threaded surface 110 cooperates with threaded surface 38 of second wall 30 to enable removable coupling of bung extractor mount 102 within second portion 31 of opening 26. In alternative embodiments, at least one of second wall 30 and mount first portion 104 includes additional or alternative structure to enable removable coupling of bung extractor mount 102 within second portion 31 of opening 26.

Bung extractor mount 102 also includes a rim 114 that has a diameter larger than opening second portion diameter 34 (shown in FIG. 1). Rim 114 is configured to facilitate seating mount 102 at a desired axial depth along second wall 30. More specifically, rim 114 abuts at least one of outer surface 44 of tank port 22 and outer surface 14 of tank wall 12 when bung extractor mount 102 is seated at the desired depth. In the example embodiment, rim 114 is disposed on mount second portion 106. The at least one seal 74 remains seated between tank port 22 and mount 102 to inhibit leakage of fluid 20 from tank cavity 18 through tank port 22.

Figure 4:
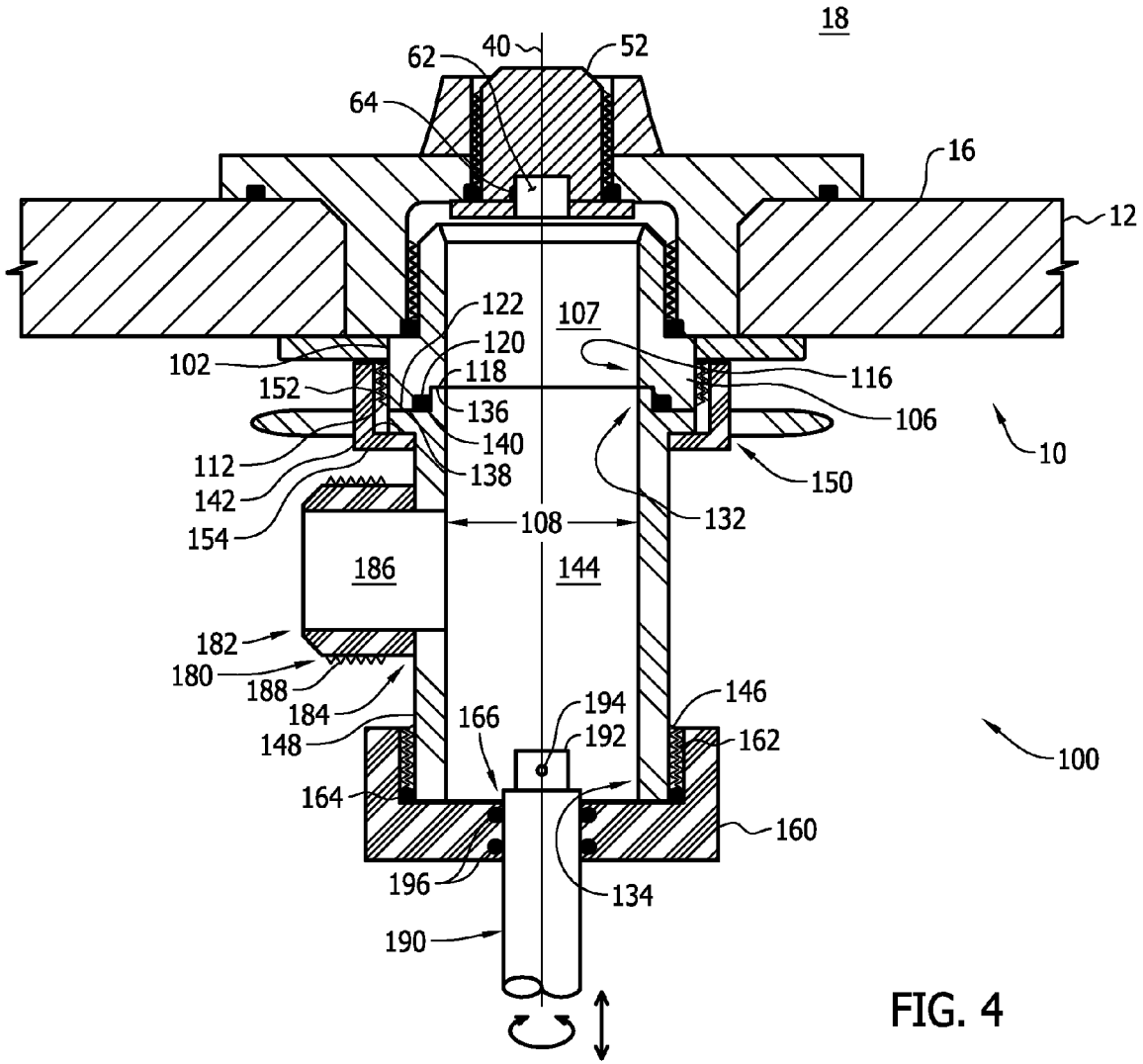
FIG. 4 is a schematic cross-sectional view of an exemplary bung extractor system, including the bung extractor mount shown in FIG. 3, and the tank port shown in FIGS. 1-3.

Mount second end 116 includes a plurality of concentric stepped surfaces 118, 120, and 122 configured for coupling to a bung extractor body 130 (shown in FIG. 4). First stepped surface 118 extends radially to a diameter 124 that is larger than internal diameter 108, second stepped surface 120 extends radially to a diameter 126 that is larger than first stepped surface diameter 124, and third stepped surface 122 extends radially to an outer diameter 128 of extractor mount 102 that is larger than second stepped surface diameter 126. In an alternative embodiment (not shown), second end 116 has a single non-stepped surface that extends radially from internal diameter 108 to outer diameter 128. It should be understood that, in alternative embodiments, second end 116 may have any suitable configuration that allows bung plug extractor system 100 to function as described herein.

Bung plug extractor system 100 also includes an example bung extractor body 130, shown coupled to bung extractor mount 102 in a schematic cross-sectional view in FIG. 4. Bung extractor body 130 includes a first end 132, an opposite second end 134, and a substantially cylindrical channel 144 extending from second end 134 through first end 132. In the example embodiment, channel 144 has diameter 108 equal to diameter 108 of channel 107. In alternative embodiments, channel 144 has a diameter that does not equal diameter 108 of channel 107 and/or that varies along channel 144.

In the example embodiment, body first end 132 includes a plurality of concentric stepped surfaces 136 and 138 configured for coupling to second end 116 of bung extractor mount 102. More specifically, first stepped surface 136 of body 130 is configured to cooperatively engage first stepped surface 118 of mount second end 116, and at least a first portion of second stepped surface 138 of body 130 is configured to cooperatively engage third stepped surface 122 of mount second end 116. In addition, at least a second portion of second stepped surface 138 cooperates with second stepped surface 120 of mount second end 116 to form a gap configured to accommodate a seal 140, such as an O-ring, to inhibit leakage of fluid 20 from between mount 102 and body 130.

Bung plug extractor system 100 further includes a clamp 150 configured to removably and sealingly couple body 130 to mount 102. More specifically, in the example embodiment shown in FIG. 4, clamp 150 includes a threaded surface 152 that cooperates with threaded surface 112 of mount second portion 106. In addition, clamp 150 includes a radially extending surface 154 configured to engage with a corresponding radially extending surface 142 of body 130. As clamp threaded surface 152 rotatably engages with mount second portion threaded surface 112, clamp surface 154 urges against body surface 142 such that body first end 132 securely couples to mount second end 116. Clamp 150 is thus configured to couple body 130 and mount 102 in a swivel joint to facilitate positioning body 130 for connection to a hose, as will be discussed herein. When body 130 is coupled to mount 102, body channel 144 is in flow communication with mount channel 107.

Mount 102 and body 130 coupled together form a bung extractor casing 135. In alternative embodiments, at least one of clamp 150, mount 102, and body 130 contain additional or alternative structure to enable removable coupling of body 130 to mount 102. In other alternative embodiments, clamp 150 is not used, and body 130 is coupled to mount 102 to form bung extractor casing 135 using any other suitable structure that allows bung plug extractor system 100 to function as described herein. In still other alternative embodiments, mount 102 is formed integrally with body 130 to form extractor casing 135. When extractor casing 135 is assembled, hose connector channel 186, extractor body channel 144, and extractor mount channel 107 are coupled in flow communication to form a sealed, continuous flow channel.

Body second end 134 is sealingly coupled to an extractor interface 160. More specifically, in the example embodiment, body second end 134 includes a threaded surface 146 configured to cooperate with a threaded surface 162 of extractor interface 160 to sealingly couple body second end 134 and extractor interface 160. Thus, extractor interface 160 seals channel 144 at body second end 134. At least one seal 164, for example an O-ring, is provided between body second end 134 and extractor interface 160 to inhibit leakage of fluid 20 from body second end 134 through extractor interface 160. In alternative embodiments, at least one of body second end 134 and extractor interface 160 contains additional or alternative structure to enable coupling of body second end 134 and extractor interface 160. In other alternative embodiments, extractor interface 160 is formed integrally with extractor body 130.

A substantially cylindrical hose connector 180 is coupled to body 130. Hose connector 180 includes a first end 182, an opposite second end 184, and a channel 186 extending through first end 182 and second end 184. Second end 184 is coupled to a wall 148 of body 130 such that hose connector channel 186 is in flow communication with body channel 144. Hose connector 180 further includes a threaded surface 188 configured to cooperate with a threaded surface of a hose (not shown) to removably and sealingly couple hose connector 180 to the hose, such that hose connector channel 186 is in flow communication with the hose. In alternative embodiments, hose connector 180 contains additional or alternative structure to enable coupling of the hose to hose connector 180.

Bung plug extractor system 100 additionally includes bung extractor 190 movably coupled to extractor interface 160. More specifically, bung extractor 190 is configured for axial movement along axis 40 and for rotational movement about axis 40. In the example embodiment, bung extractor 190 is a shaft that extends through an opening 166 defined in extractor interface 160.

Bung extractor 190 includes tip portion 192 configured to releasably engage bung plug 52. For example, in the embodiment illustrated in FIG. 4, tip portion 192 is configured to be received within gap 62 of bung plug 52. Moreover, tip portion 192 includes detent 194 configured to releasably engage notch 64, as described previously. For example, bung extractor 190 includes a suitable mechanism (not shown) to enable detent 194 alternatively to extend from and withdraw into tip portion 192, such that detent 194 correspondingly engages and releases the at least one notch 64. In alternative embodiments, bung extractor 190 and/or tip portion 192 includes additional or alternative structure to enable tip portion 192 to releasably engage bung plug 52. At least one seal 196, for example an O-ring, is provided between bung extractor 190 and extractor interface opening 166 to inhibit leakage of fluid 20 from body channel 144 through extractor interface opening 166. In the example embodiment, the at least one seal 196 includes two seals 196.

Figure 5:
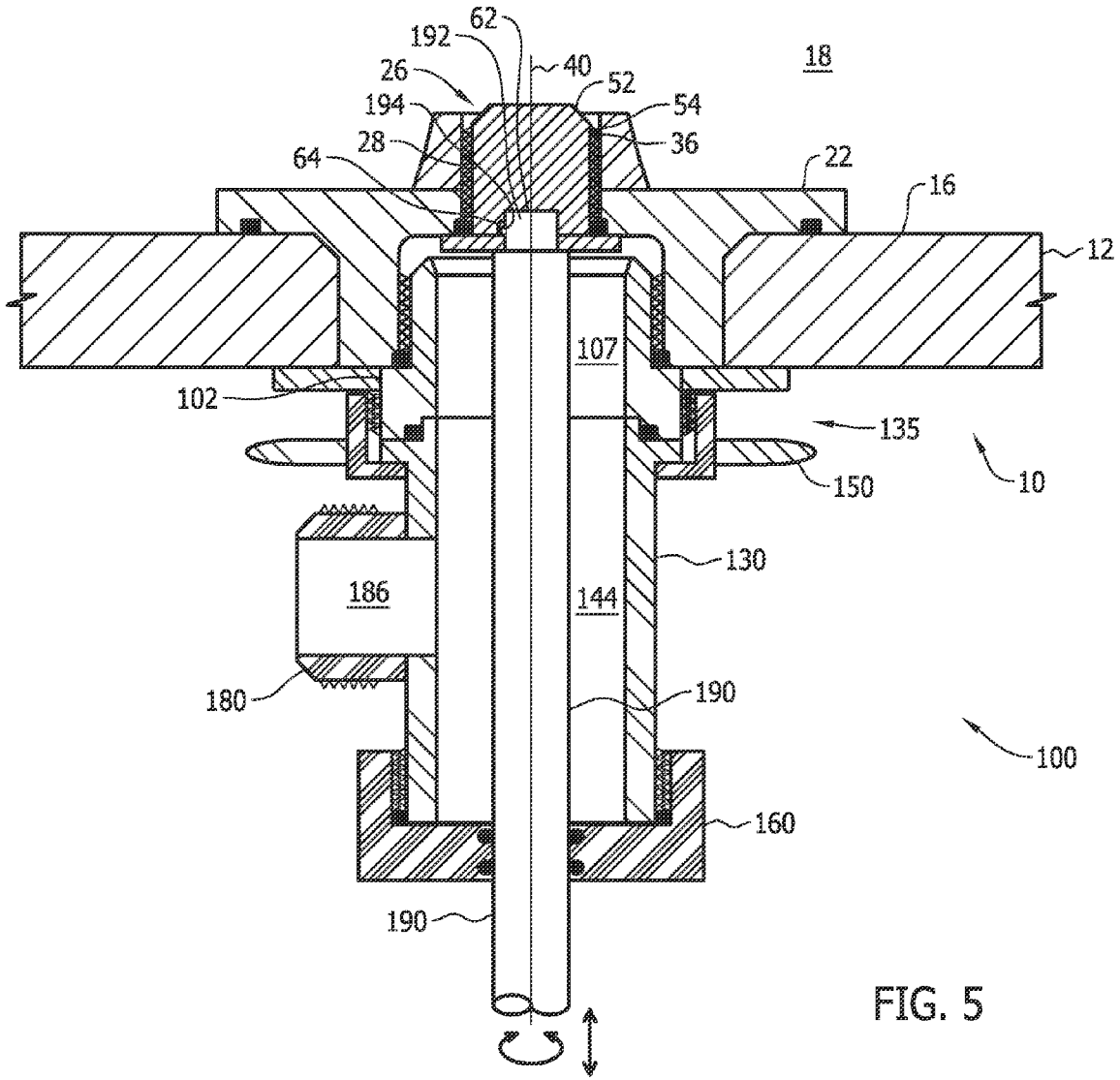
FIG. 5 is a schematic cross-sectional view of the bung plug extractor system shown in FIGS. 3-4 and including an exemplary bung extractor tip portion received by the example bung plug shown in FIGS. 2-4.

FIG. 5 is a schematic cross-sectional view of the example embodiment of bung plug extractor system 100 coupled to the example embodiment of bung plug 52. More specifically, bung extractor 190 is extended along axis 40 through bung extractor body channel 144 and bung extractor mount channel 107 such that tip portion 192 is received in bung plug gap 62. Moreover, bung extractor 190 is rotated about axis 40 such that detent 194 is engaged with bung plug notch 64, thus releasably coupling bung extractor 190 and bung plug 52.

When bung extractor 190 and bung plug 52 are coupled together, bung extractor 190 can be operated to remove bung plug 52 from tank port 22. For example, in the embodiment illustrated in FIG. 5, bung extractor 190 can be rotated about axis 40 such that bung plug threaded surface 54 rotatably disengages with threaded surface 36 of tank port first wall 28. Bung extractor 190 is thus configured to uncouple bung plug 52 from opening 26.

Figure 6:
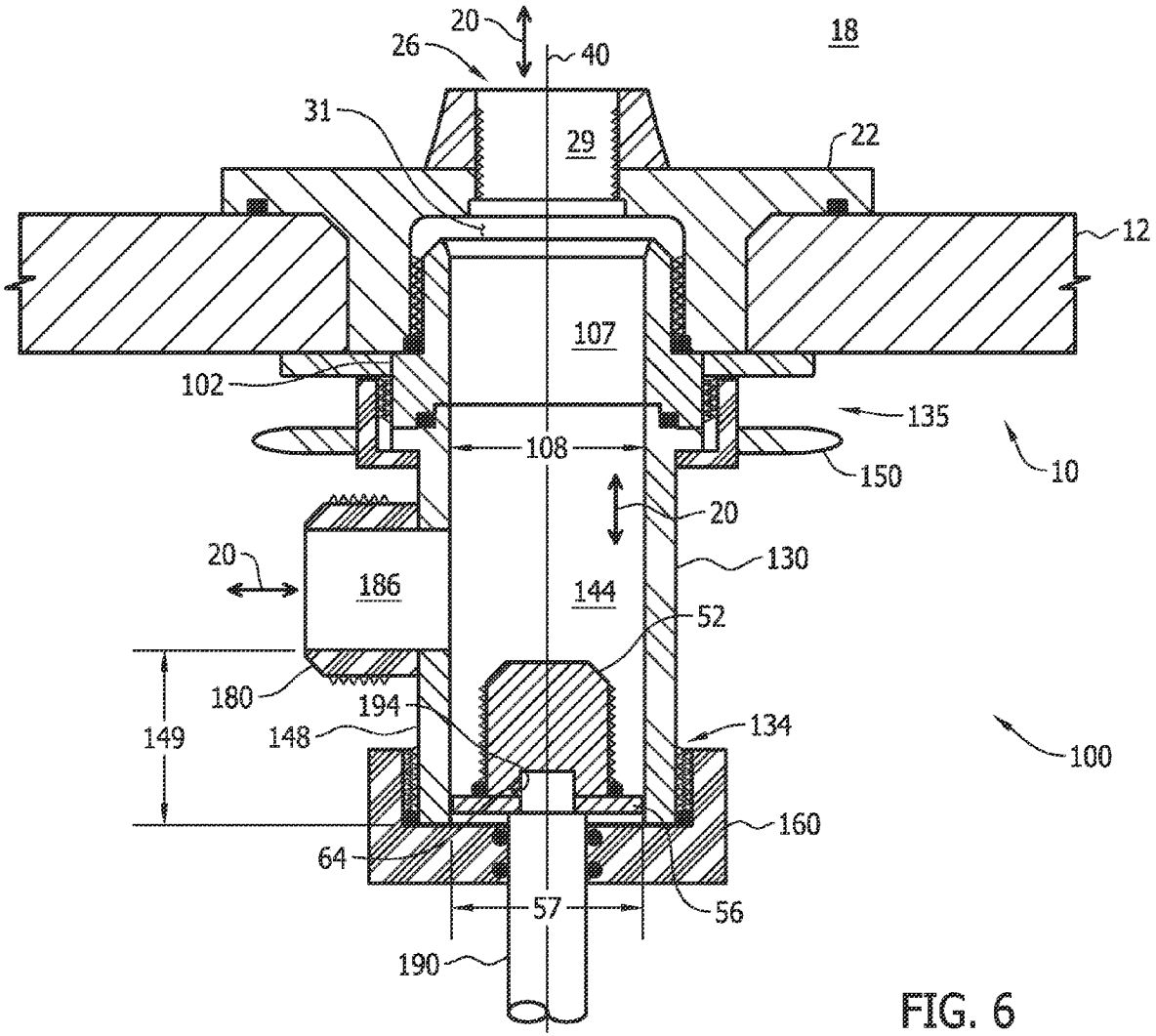
FIG. 6 is a schematic cross-sectional view of the bung plug shown in FIGS. 2-5 and extracted from the tank port shown in FIGS. 1-5 using the bung plug extractor system shown in FIGS. 4-5.

FIG. 6 is a schematic cross-sectional view of the example embodiment of bung plug 52 extracted from tank port 22 using the example embodiment of bung plug extractor system 100. More specifically, after bung plug 52 is uncoupled from tank port 22, bung extractor 190 is retracted along axis 40 to second end 134 of bung extractor body 130. Bung plug 52 remains coupled to bung extractor 190, and retraction of bung plug 52 through mount channel 107 and body channel 144 is facilitated because diameter 108 is at least slightly larger than diameter 57 of bung plug rim 56, as described above.

When bung plug 52 is uncoupled from opening 26 of tank port 22, any fluid 20 released from tank cavity 18 is substantially constrained within a sealed flow path through first portion 29 and second portion 31 of opening 26 in tank port 22, mount channel 107, body channel 144, and hose connector channel 186. Accordingly, fluid 20 may be exchanged through the sealed flow path between tank cavity 18 and a hose (not shown) coupled to hose connector 180 while tank 10 is pressurized, without spillage or leakage, and without need for a dedicated valve coupled to tank port 22. For example, setting the hose pressure higher than the pressure within tank cavity 18 facilitates adding fluid to the tank, while setting the hose pressure lower than the pressure within tank cavity 18 facilitates draining fluid or venting fluid (for example, venting a gas) from the tank.

After retraction of bung extractor 190, bung plug 52 is retained in extractor body channel 144. Thus, fluid 20 flowing through bung plug extractor system 100 is exposed to an exterior surface of bung plug 52. As described above, cap 70 (shown in FIG. 2) facilitates protecting bung plug 52 from dirt, debris, corrosion, or other environmental conditions while bung plug 52 is installed in tank port 22, thus reducing the potential introduction of such materials into fluid 20. In certain embodiments, at least a portion of the exterior surface of bung plug 52 may cleaned prior to coupling bung plug extractor system 100 to tank port 22.

In the example embodiment, bung plug 52 is retained in extractor body channel 144 adjacent body second end 134. A length 149 of bung extractor body 130 between second end 134 and hose connector 180 is such that, when bung plug extractor 190 is fully retracted, coupled bung plug 52 does not directly obstruct flow between hose connector channel 186 and opening 26. In alternative embodiments, when bung plug extractor 190 is fully retracted, coupled bung plug 52 may partially obstruct the flow between hose connector channel 186 and opening 26. In other alternative embodiments, bung plug 52 is retained within body channel 144 without fully retracting bung extractor 190, and coupled bung plug 52 may partially obstruct the flow between hose connector channel 186 and opening 26.

When the desired fluid exchange operation is completed, bung extractor 190 can be operated to reinstall bung plug 52 into tank port 22. For example, in the embodiment illustrated in FIG. 6, bung extractor 190 can be extended along axis 40 and rotated about axis 40 such that bung plug threaded surface 54 rotatably engages with threaded surface 36 of tank port first wall 28. Bung extractor 190 is thus configured to couple bung plug 52 within opening 26 to seal tank port 22 while bung plug extractor system 100 remains coupled to tank port 22. Moreover, detent 194 is configured to be withdrawn from notch 64, as described above, enabling bung extractor 190 to be uncoupled from bung plug 52 after bung plug 52 is re-coupled and seated at the desired axial depth along first wall 28 of opening 26, as described above. Extractor casing 135 may then be uncoupled from sealed tank port 22, and cap 70 (shown in FIG. 2) coupled within second portion 31 of opening 26.

In an embodiment, where tank 10 is to be filled with a liquid, a first bung plug extractor system 100 is coupled to a tank fill/drain port, such as a first tank port 22, and a second bung plug extractor system 100 is coupled to a tank vent port, such as a second tank port 22. A pressure for a first hose connected to first bung plug extractor system 100 is set higher than the pressure within tank cavity 18, and a pressure for a second hose connected to the second bung plug extractor system 100 is set lower than the pressure within tank cavity 18, to facilitate adding liquid to the tank while venting an ullage gas from the tank. Similarly, where a liquid is to be drained from tank 10, the pressure for the first hose connected to first bung plug extractor system 100 is set lower than the pressure within tank cavity 18, and the pressure for the second hose connected to second bung plug extractor system 100 is set higher than the pressure within tank cavity 18, to facilitate draining liquid from the tank while adding ullage gas to the tank. In alternative embodiments, tank 10 is configured for automatic ullage gas volume compensation when a liquid is filled or drained through first tank port 22.

Figure 7:
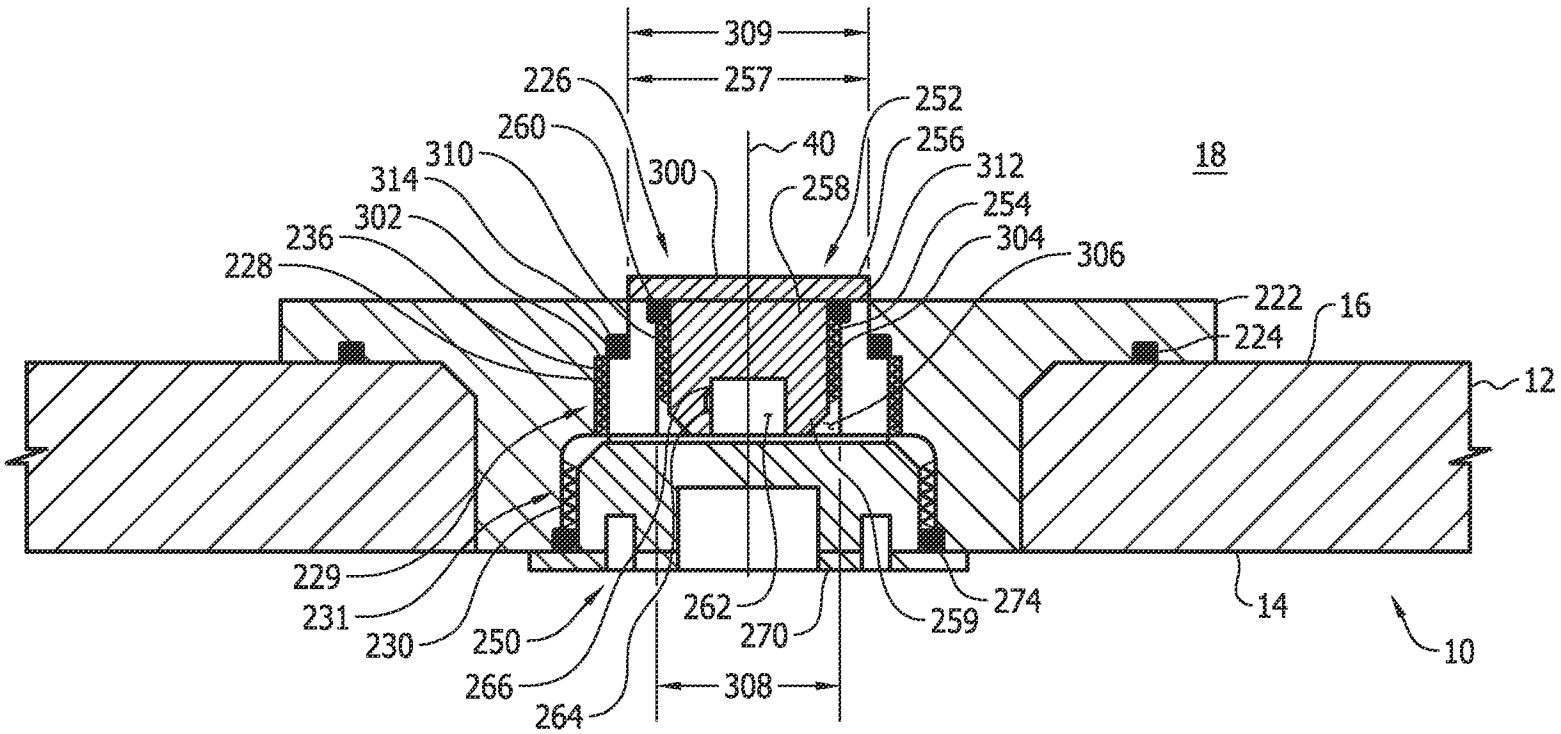
FIG. 7 is a schematic cross-sectional view of another exemplary bung plug and tank port that may be used with the tank wall shown in FIG. 1.

FIG. 7 is a schematic cross-sectional view of another example embodiment of a bung plug assembly, in this case bung plug assembly 250, installed in a tank port 222. Similar to tank port 22, as described above, tank port 222 may be a fill/drain port or a vent port, for example. Tank port 222 extends through outer surface 14 and inner surface 16 of tank wall 12. In the example embodiment, at least one seal 224, for example an O-ring, is provided between tank port 222 and tank wall 12 to inhibit leakage of fluid 20 from tank cavity 18 through tank wall 12. In alternative embodiments, tank port 222 is formed integrally with tank wall 12. An opening 226 extends through tank port 222 along axis 40.

Bung plug assembly 250 includes an annular insert 300 configured to be removably coupled within a first portion 229 of opening 226 adjacent a first wall 228. In the example embodiment, when annular insert 300 is coupled within first portion 229, annular insert 300 is concentric with first portion 229 about axis 40. In the example embodiment, at least one seal 314, for example an O-ring, is provided between insert 300 and tank port 222 to inhibit leakage of fluid 20 from tank cavity 18 through tank port 222.

In the example embodiment, insert 300 includes a first threaded surface 302 that is configured to cooperate with a threaded surface 236 of first wall 228 to enable removable coupling of insert 300 within first portion 229 of opening 226. In alternative embodiments, at least one of insert 300 and first wall 228 contains additional or alternative structure to enable removable coupling of insert 300 within first portion 229 of opening 226. Annular insert 300 also includes a radially inner wall 304 that defines a channel 306 having a diameter 308. Inner wall 304 includes a second threaded surface 310.

Bung plug assembly 250 further includes a bung plug 252 configured to be removably and sealingly coupled within channel 306 of insert 300. In the example embodiment, bung plug 252 includes a threaded surface 254 that cooperates with second threaded surface 310 to enable removable coupling of bung plug 252 within channel 306. In alternative embodiments, at least one of insert 300 and bung plug 252 contains additional or alternative structure to enable removable coupling of bung plug 252 within channel 306.

In the example embodiment, bung plug 252 also includes a rim 256 that has a diameter 257 larger than insert channel diameter 308. Rim 256 is configured to facilitate seating bung plug 252 at a desired axial depth along inner wall 304 of insert 300. More specifically, rim 256 abuts at least one of an end surface 312 of insert 300 and an interior surface 242 of tank port 22 when bung plug 252 is seated at the desired depth. In the example embodiment, rim 256 is disposed at a second end 258 of bung plug 252. In alternative embodiments, rim 256 is disposed at an intermediate axial location along bung plug 252. In the example embodiment, at least one seal 260, for example an O-ring, is provided between insert 300 and bung plug 252 to inhibit leakage of fluid 20 from tank cavity 18 through insert 300.

In embodiments where bung plug rim diameter 257 is larger than insert channel diameter 308, bung plug 252 cannot be removed through insert channel 306. To enable removal of bung plug 252 from the tank, for example for maintenance or replacement, insert 300 can be rotated about axis 40 such that insert first threaded surface 302 rotatably disengages with threaded surface 236 of first wall 228. Thus, insert 300 is configured for removal outside of tank 10 through tank port 222, facilitating external maintenance or replacement of bung plug 252.

Bung plug 252 is configured to be releasably engaged by tip portion 192 of bung extractor 190 (shown in FIG. 4). For example, in the embodiment illustrated in FIG. 7, bung plug 252 includes a gap 262 defined in first end 259. Gap 262 is at least partially defined by an outer surface 266 of bung plug 252. At least one notch 264 is defined in bung plug outer surface 266, and the at least one notch 264 is configured to engage detent 194 disposed on tip portion 192, thus enabling bung plug 252 to be releasably engaged by tip portion 192. In alternative embodiments, bung plug 252 includes additional or alternative structure to enable bung plug 252 to be releasably engaged by tip portion 192.

Bung plug assembly 250 additionally includes a cap 270 that is substantially the same as cap 70, as described above, configured to be coupled within a second portion 231 of opening 226 adjacent a second wall 230. In the example embodiment, at least one seal 274, for example an O-ring, is provided between tank port 222 and cap 270 to inhibit leakage of fluid 20 from tank cavity 18 through tank port 222.

Figure 8:
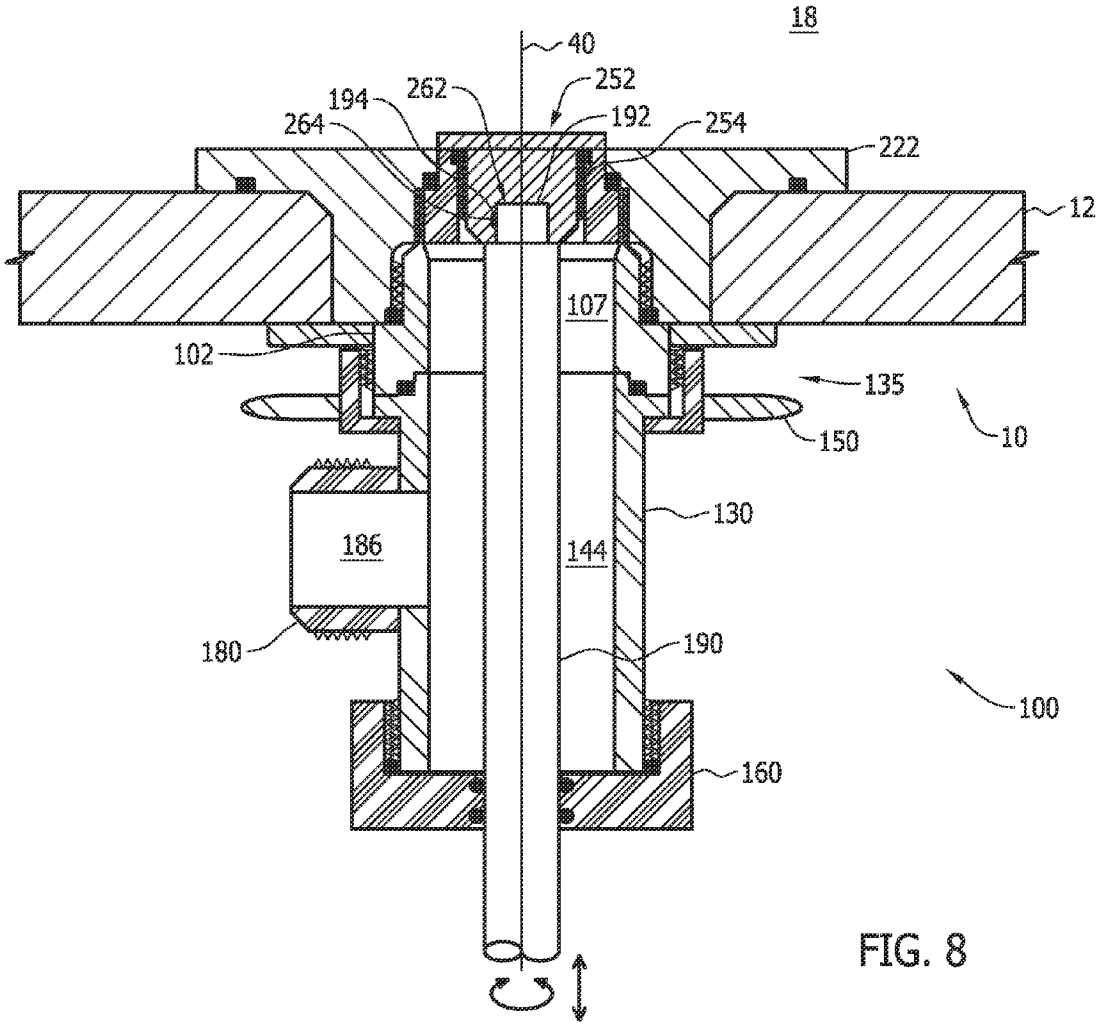
FIG. 8 is a schematic cross-sectional view of the bung plug extractor system shown in FIGS. 4-6 coupled to the tank port shown in FIG. 7.

FIG. 8 is a schematic cross-sectional view of the example embodiment of bung plug extractor system 100 coupled to the example embodiment of bung plug 252. More specifically, bung extractor 190 is extended along axis 40 through bung extractor body channel 144 and bung extractor mount channel 107 such that tip portion 192 is received in bung plug gap 262. Moreover, bung extractor 190 is rotated about axis 40 such that detent 194 is engaged with bung plug notch 264, thus releasably coupling bung extractor 190 and bung plug 252. In alternative embodiments, bung extractor 190 and/or tip portion 192 includes additional or alternative structure to enable tip portion 192 to releasably engage bung plug 252.

When bung extractor 190 and bung plug 252 are coupled together, bung extractor 190 can be operated to remove bung plug 252 from tank port 222. For example, in the embodiment illustrated in FIG. 8, bung extractor 190 can be rotated about axis 40 such that bung plug threaded surface 254 rotatably disengages with second threaded surface 310 of insert inner wall 304. Bung extractor 190 is thus configured to uncouple bung plug 252 from opening 226.

Figure 9:
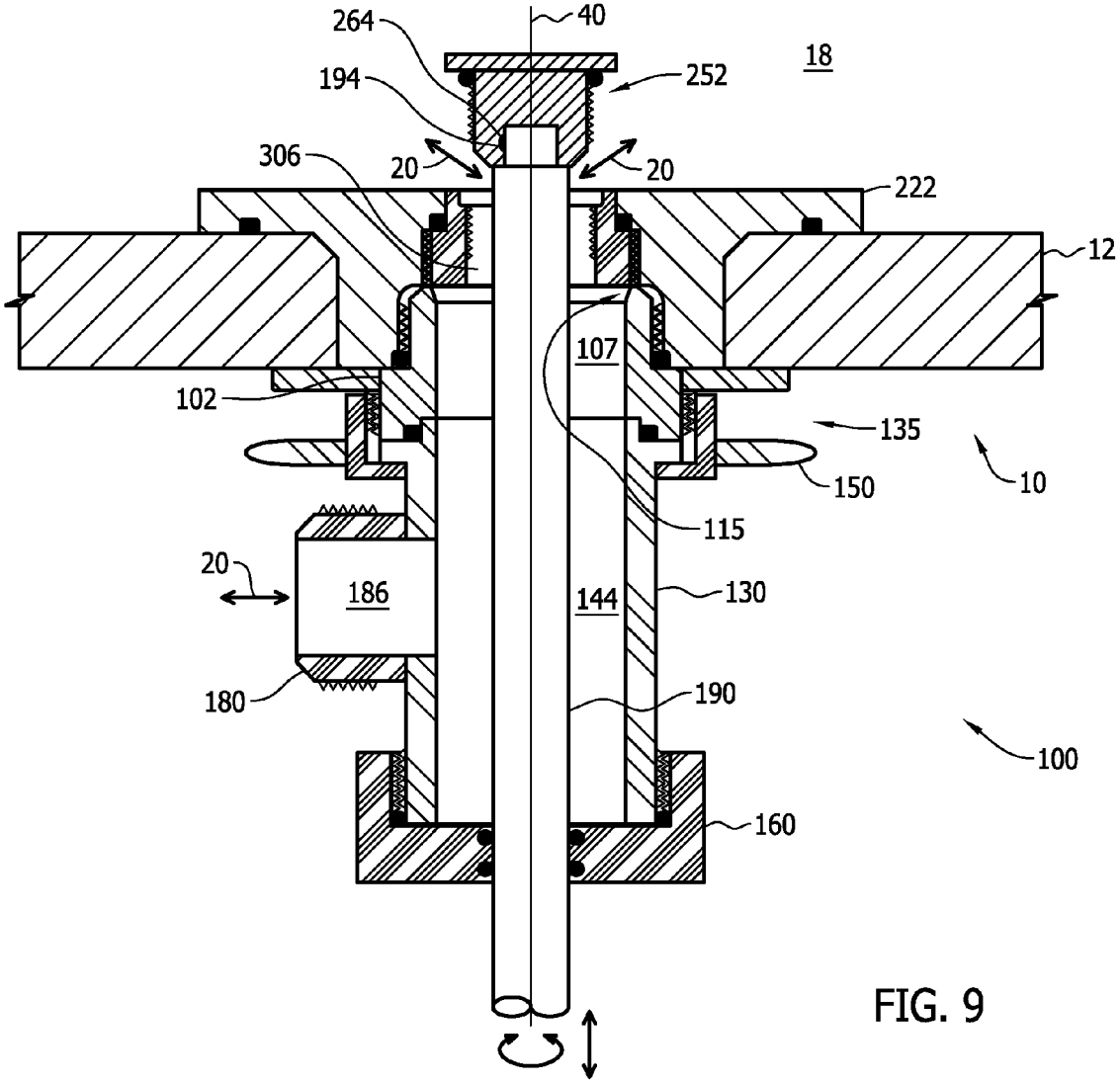
FIG. 9 is a schematic cross-sectional view of the bung plug shown in FIGS. 7 and 8 and extracted from the tank port shown in FIGS. 7 and 8 using the bung plug extractor system shown in FIGS. 4-6 and 8.

FIG. 9 is a schematic cross-sectional view of the example embodiment of bung plug 252 extracted from tank port 222 using the example embodiment of bung plug extractor system 100. More specifically, after bung plug 252 is uncoupled from insert 300, bung extractor 190 is extended along axis 40 through insert channel 306. Bung plug 52 remains coupled to bung extractor 190, and is extended into tank cavity 18.

When bung plug 52 is uncoupled from opening 226 of tank port 222, any fluid 20 released from tank cavity 18 is substantially constrained within a sealed flow path through insert channel 306 in tank port 222, mount channel 107, body channel 144, and hose connector channel 186. Accordingly, fluid 20 may be exchanged through the sealed flow path between tank cavity 18 and a hose (not shown) coupled to hose connector 180 while tank 10 is pressurized, without spillage, and without need for a dedicated valve coupled to tank port 222. For example, setting the hose pressure higher than the pressure within tank cavity 18 facilitates adding fluid to the tank, while setting the hose pressure lower than the pressure within tank cavity 18 facilitates draining fluid from the tank.

After extension of bung extractor 190, bung plug 252 is correspondingly positioned within tank cavity 18. Thus, fluid 20 flowing through bung plug extractor system 100 is exposed to an exterior surface of bung plug 252. As described above, cap 270 (shown in FIG. 7) facilitates protecting bung plug 252 from dirt, debris, corrosion, or other environmental conditions while bung plug 252 is installed in tank port 222, thus reducing the potential introduction of such materials into fluid 20. In certain embodiments, at least a portion of the exterior surface of bung plug 252 may cleaned prior to coupling bung plug extractor system 100 to tank port 222.

When the desired fill or drain operation is completed, bung extractor 190 can be operated to reinstall bung plug 252 into tank port 222. For example, in the embodiment illustrated in FIG. 9, bung extractor 190 can be retracted along axis 40 and rotated about axis 40 such that bung plug threaded surface 254 rotatably engages with second threaded surface 310 of insert inner wall 304. Bung extractor 190 is thus configured to couple bung plug 252 within opening 226 to seal tank port 222 while bung plug extractor system 100 remains coupled to tank port 222. Detent 194 is configured to be withdrawn from notch 264, as described above, enabling bung extractor 190 to be uncoupled from bung plug 252 after bung plug 252 is re-coupled and seated at the desired axial depth along inner wall 304 of insert 300, as described above. Extractor casing 135 may then be uncoupled from sealed tank port 222, and cap 270 (shown in FIG. 7) coupled within second portion 231 of opening 226.

Figure 10:
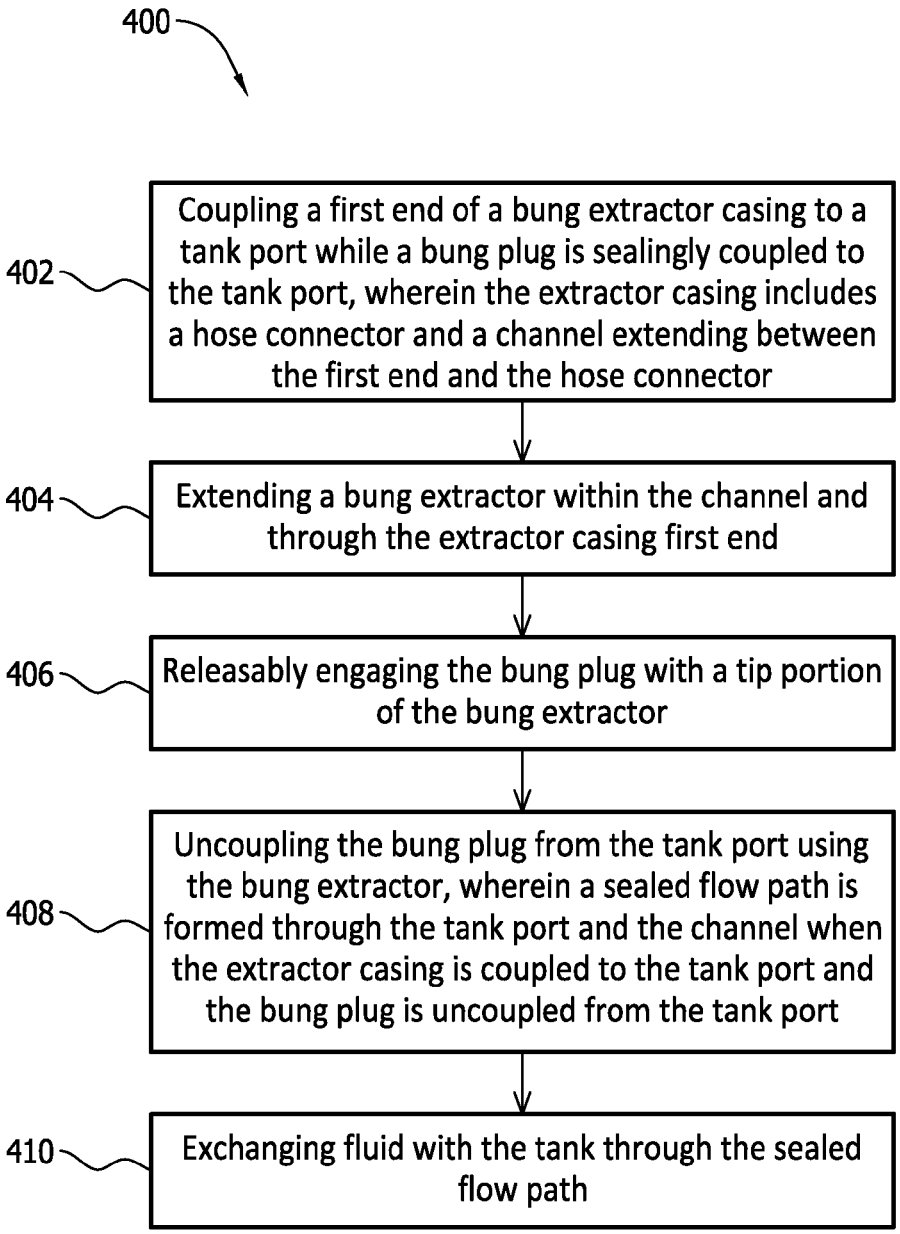
FIG. 10 is a flow diagram of an exemplary method 400 of exchanging fluid with a tank through a tank port, such as the tank ports shown in FIG. 1 and FIG. 7.

FIG. 10 is a flow diagram of an example method 400 of exchanging fluid with a tank, such as tank 10, through a tank port, such as tank port 22 or 222, sealable by a bung plug, such as bung plug 52 or 252. Method 400 includes coupling 402 a first end of a bung extractor casing, such as first end 115 of bung extractor mount 102 of bung extractor casing 135, to the tank port while the bung plug is sealingly coupled to the tank port. The extractor casing includes a second end opposite the first end, such as second end 134 of extractor body 130 of extractor casing 135. The extractor casing also includes a hose connector, such as hose connector 180, and a channel extending between the first end and the hose connector, such as the channel formed by extractor mount channel 107, extractor body channel 144, and hose connector channel 186.

Method 400 also includes extending 404 a bung extractor, such as bung extractor 190, within the channel and through the extractor casing first end, wherein the bung extractor is extendably coupled at the extractor casing second end. Method 400 further includes releasably engaging 406 the bung plug with a tip portion of the bung extractor, such as tip portion 192 of bung extractor 190. Additionally, method 400 includes uncoupling 408 the bung plug from the tank port using the bung extractor, wherein a sealed flow path is formed through the tank port and the channel when the extractor casing is coupled to the tank port and the bung plug is uncoupled from the tank port. Moreover, method 400 includes exchanging 410 fluid with the tank through the sealed flow path.

Each of the processes of method 400 may be performed or carried out by a system integrator, a third party, and/or a customer. For the purposes of this description, a system integrator may include without limitation any number of aircraft manufacturers and major-system subcontractors; a third party may include without limitation any number of venders, subcontractors, and suppliers; and a customer may be an airline, leasing company, military entity, service organization, and so on. Moreover, although the example embodiments are discussed in the context of a propellant or pressurant tank used within a liquid rocket, the principles of the disclosure may be applied to tanks used in other applications or industries, such as pressurized tanks used in connection with submersibles, for example.

The implementations described herein enable fluid exchange with a tank, such as occurs when filling, draining, and venting the tank, while the tank contents are under pressure. Multiple seals are used to inhibit leakage of the fluid, and the external connection to the tank port is straightforward, facilitating decreased spillage. The extractor casing may be re-used for fluid exchange with multiple tanks, while the tank port, bung plug, and cap needed for each tank may be relatively simple and inexpensive to manufacture.

The implementations described herein provide improvements over at least some known tank port fluid transfer hardware. As compared to at least some known tank ports with dedicated high-pressure fill/drain valves and vent valves, the bung plug extractor system described herein decreases a tank weight and cost by eliminating a need for on-board valve hardware. In addition, the bung plug extractor system described herein decreases a volume needed within the tank for components, and correspondingly increases a volume available for fluid storage for a given tank footprint. Accordingly, the described systems and methods facilitate a reduction in weight, cost, and component volume for each pressurized tank.

This written description uses examples to disclose various implementations, which include the best mode, to enable any person skilled in the art to practice those implementations, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus for use in exchanging fluid with a tank, said apparatus comprising:

a bung extractor casing extending from a first end to an opposite second end, said bung extractor casing comprising:

a bung extractor mount coupled to a bung extractor body, wherein said extractor casing first end comprises a first end of said extractor mount, and said extractor casing second end comprises a second end of said extractor body, said extractor casing first end configured to removably couple to a tank port, the tank port configured to be sealingly coupled to a bung plug;

a hose connector disposed on said extractor body, said hose connector configured to removably couple to a hose; and an extractor casing channel defined between said extractor casing first end and said hose connector, said extractor casing channel comprising a hose connector channel, an extractor body channel, and an extractor mount channel in flow communication;

a clamp configured to removably couple said extractor body to said extractor mount in a swivel joint; and a bung extractor coupled to said extractor casing second end, said bung extractor comprises a tip portion configured to releasably engage the bung plug, said bung extractor is operable to selectively uncouple the bung plug from the tank port such that a sealed flow path is formed through the tank port and said extractor casing channel.

2. The apparatus in accordance with claim 1, further comprising an extractor interface coupled to said extractor casing second end, wherein said extractor interface comprises an opening through which said bung extractor is extendably coupled.

3. The apparatus in accordance with claim 1, wherein said tip portion comprises a detent configured to releasably engage at least one notch defined in the bung plug when said bung extractor is extended through said extractor casing first end.

4. The apparatus in accordance with claim 1, wherein the bung plug comprises a bung plug threaded surface that cooperates with a tank port threaded surface, said bung extractor is operable to rotatably disengage the bung plug threaded surface from the tank port threaded surface when said tip portion is engaged with the bung plug.

5. A bung plug extractor system for use in exchanging fluid with a tank, said bung plug extractor system comprising:

a bung plug configured to sealingly couple to a tank port;

a bung extractor casing extending from a first end to an opposite second end, said bung extractor casing comprising:

a bung extractor mount coupled to a bung extractor body, wherein said extractor casing first end comprises a first end of said extractor mount, and said extractor casing second end comprises a second end of said extractor body, said extractor casing first end configured to removably couple to the tank port;

a hose connector disposed on said extractor body, said hose connector configured to removably couple to a hose; and an extractor casing channel defined between said extractor casing first end and said hose connector, said extractor casing channel comprising a hose connector channel, an extractor body channel, and an extractor mount channel in flow communication;

a clamp configured to removably couple said extractor body to said extractor mount in a swivel joint; and a bung extractor coupled to said extractor casing second end, said bung extractor comprises a tip portion configured to releasably engage said bung plug, said bung extractor is operable to selectively uncouple said bung plug from the tank port such that a sealed flow path is formed through the tank port and said extractor casing channel.

6. The system in accordance with claim 5, further comprising an extractor interface coupled to said extractor body second end, wherein said extractor interface comprises an extractor interface opening through which said bung extractor is extendably coupled.

7. The system in accordance with claim 5, wherein said tip portion comprises a detent configured to releasably engage at least one notch defined in said bung plug when said bung extractor is extended through said extractor casing first end.

8. The system in accordance with claim 5, wherein said bung plug comprises a bung plug threaded surface that cooperates with a tank port threaded surface, said bung extractor is operable to rotatably disengage said bung plug threaded surface from the tank port threaded surface when said tip portion is engaged with said bung plug.

9. The system in accordance with claim 5, wherein an insert is coupled within the tank port, the insert comprises an insert channel, wherein said bung plug is configured to removably couple to the insert.

10. A method of exchanging fluid with a tank, said method comprising:

coupling a first end of a bung extractor casing to a tank port, wherein a bung plug remains sealingly coupled to the tank port as the first end is coupled thereto, and wherein the extractor casing comprises:

a second end opposite the first end;

a bung extractor mount coupled to a bung extractor body, wherein the extractor casing first end includes a first end of the extractor mount, and the extractor casing second end includes a second end of the extractor body;

a hose connector disposed on the extractor body;

an extractor casing channel defined between the extractor casing first end and the hose connector, the extractor casing channel including a hose connector channel, an extractor body channel, and an extractor mount channel in flow communication; and a clamp configured to removably couple the extractor body to the extractor mount in a swivel joint;

extending a bung extractor through the extractor casing channel and through the extractor casing first end, wherein the bung extractor is extendably coupled to the extractor casing second end;

releasably engaging the bung plug with a tip portion of the bung extractor;

uncoupling the bung plug from the tank port using the bung extractor such that a sealed flow path is formed through the tank port and the extractor casing channel; and exchanging fluid with the tank through the sealed flow path.

11. The method in accordance with claim 10, further comprising retaining the bung plug within the channel.

12. The method in accordance with claim 10, further comprising retaining the bung plug within the tank.

13. The method in accordance with claim 10, further comprising recoupling the bung plug within the tank port using the bung extractor after said exchanging fluid with the tank is completed.

14. The method in accordance with claim 13, further comprising disengaging the tip portion of the bung extractor from the bung plug after said recoupling the bung plug within the tank port is completed.

15. The method in accordance with claim 14, further comprising uncoupling the extractor casing from the tank port after said disengaging the tip portion of the bung extractor is completed.

16. The method in accordance with claim 10, wherein said releasably engaging the bung plug comprises engaging at least one notch defined in the bung plug with a detent disposed on the tip portion of the bung extractor.

17. The method in accordance with claim 10, wherein said exchanging fluid with the tank through the sealed flow path comprises coupling a hose to the connector, and at least one of:

setting a hose pressure higher than a pressure within the tank to facilitate adding fluid to the tank; and setting the hose pressure lower than the pressure within the tank to facilitate draining fluid from the tank.

* * * * *